United States Patent [19]

Kimura

[11] Patent Number: 4,757,306

[45] Date of Patent: Jul. 12, 1988

[54] SEPARATION TYPE LIGHT EXTINCTION SMOKE DETECTOR

[75] Inventor: Tetsuo Kimura, Tokyo, Japan

[73] Assignee: Nittan Co., Ltd., Tokyo, Japan

[21] Appl. No.: 1,449

[22] Filed: Jan. 8, 1987

[30] Foreign Application Priority Data

Jan. 9, 1986 [JP] Japan ..... 61-001417

[51] Int. Cl.[4] ..... G08B 17/10

[52] U.S. Cl. ..... 340/630; 340/628; 340/587; 250/565; 250/574

[58] Field of Search ..... 340/630, 629, 628, 584, 340/577, 578, 579, 586, 587; 250/565

[56] References Cited

U.S. PATENT DOCUMENTS

| | | | |
|---|---|---|---|
| 4,308,531 | 12/1981 | Yamamoto | 340/630 |
| 4,586,026 | 4/1986 | Braig | 250/565 |
| 4,638,304 | 1/1987 | Kimura | 340/630 |

*Primary Examiner*—Joseph A. Orsino, Jr.
*Assistant Examiner*—Jill D. Jackson
*Attorney, Agent, or Firm*—Hill, Van Santen, Steadman & Simpson

[57] ABSTRACT

A separation type light blocking smoke detector detects smoke present between a light emitting section and a light receiving section spaced therefrom by detecting blocking of light between the light emitting section and the light receiving section. The detector includes a light emitting section driving circuit, a counting circuit, and a storage circuit. The light emitting section driving circuit changes the emission intensity of the light emitting section in accordance with a predetermined changing mode for every repetitive cycle. The counting circuit includes a first comparator and an updating signal generator, and counts a physical amount corresponding to a period during which an output from the light emitting section falls in a predetermined range for each repetitive changing cycle. The storage circuit includes a second comparator and an AND gate, and stores a count value of the counting circuit in an arbitrary repetitive cycle. The count value stored in the storage circuit and that from the counting circuit are compared by a third comparator.

7 Claims, 2 Drawing Sheets

SEPARATION TYPE LIGHT EXTINCTION SMOKE DETECTOR

BACKGROUND OF THE INVENTION

1. Field of the Invention

The present invention relates to a separation type light extinction smoke detector, which can detect smoke present between a light emitting section and a light receiving section spaced therefrom, by detecting extinction or blocking of light between the light emitting section and the light receiving section, and which is particularly effective when smoke caused by a fire is to be detected.

2. Description of the Prior Art

To monitor the occurrence of a fire in an elongated space, e.g., a tunnel or pipe utility conduit, a separation type light extinction smoke detector is conventionally used. In this detector, a light emitting section and a light receiving section are separately arranged with the elongated space therebetween, and smoke present in the space is detected by detecting attenuation, due to smoke, of light from the light emitting section directed to the light receiving section. When the detector is installed, an initial condition in a normal state wherein there is no smoke is set in the light receiving section. More specifically, when the emission intensity of the light emitting section is constant, the intensity of light incident in the light receiving section varies in accordance with a distance between the light emitting and light receiving sections. When the distance between the two sections is short, a detection output at the light receiving section side is saturated and this disables detection of a change in the amount of light received caused by smoke. Therefore, the emission intensity of the light emitting section must be adjusted not to cause saturation of the detection output of the light receiving section.

To achieve the above adjustment, the characteristics of an amplifier connected to an output terminal of a light-receiving element of the light receiving section are adjusted. However, fine adjustment is required, resulting in a cumbersome operation.

SUMMARY OF THE INVENTION

It is an object of the present invention to provide a separation type light extinction smoke detector, wherein the initial condition of an amplifier connected to an output terminal of a light receiving element can be quickly and easily set and changed.

In accordance with the principles of the present invention, the above object is achieved in a separation type light extinction smoke detector which detects smoke present between a light emitting section and a light receiving section spaced therefrom, by detecting extinction of light from the light emitting section by the light receiving section, the detector including light emitting section driving means for changing an emission intensity of the light emitting section in accordance with a predetermined changing mode for every repetitive cycle; counting means for counting a physical amount corresponding to a period during which an output from the light emitting section falls in a predetermined range for each repetitive changing cycle; storage means for storing a count value of the counting means in an arbitrary repetitive cycle; and comparing means for comparing the count value stored in the storage means with that from the counting means.

DESCRIPTION OF THE PREFERRED EMBODIMENTS

The principle of the present invention will be described prior to a detailed description of the preferred embodiments.

An emission output I of a light emitting element of a light emitting section cyclically changes according to the following relation:

$$I = I_0 e^{-\alpha t}$$

where $I_0$ is an initial emission output, and $\alpha$ is a time constant. An output E of an amplifier connected to the output terminal of the light receiving element in the light receiving section is expressed by the following relations:

$E = (1-k_0)AI_0e^{-\alpha t}$ *(nonsaturated region)*

$E = E_0$ (saturated region)

(where $k_0$ is an attenuation rate when there is no smoke in a monitoring space, and A is a conversion efficiency factor of the light receiving element and accounting for the gain of the amplifier).

Figure 1:
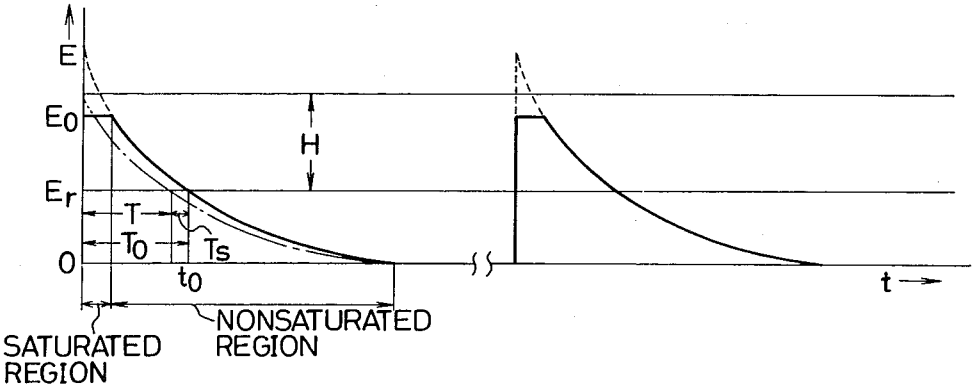
FIG. 1 is a graph for explaining the operation of a separation type light extinction smoke detector according to the present invention.

The graph of FIG. 1 illustrates the output E. In FIG. 1, a time t is plotted along the abscissa, and the output E of the amplifier is plotted along the ordinate.

Assuming that a time $t_0$ until the output E reaches $E_r$ ($<E_0$) is a period $T_0$ during which the output E falls within a predetermined voltage range H, the period $T_0$ is expressed by:

$$T_0 = -\alpha \ln[E_r/\{(1-k_0)AI_0\}]$$

If smoke enters the monitoring space and the attenuation rate k changes, a period T during which the output E of the amplifier falls within the predetermined voltate range H is expressed by:

$$T = -\alpha \ln [E_r/\{(1-K_0)AT_0\}]$$

Therefore, a difference $T_s$ caused by the presence/absence of smoke is given by:

$$T_s = T_0 - T = -\alpha \ln(1-k)$$

In this manner, since a change in attenuation rate appears as the difference $T_s$ between the periods during which the output E falls in the predetermined voltage range H, when the difference $T_s$ reaches a level at which generation of smoke due to a fire can be judged, an alarm signal can be generated.

The preferred embodiments of the present invention will be described hereinafter.

Figure 2:
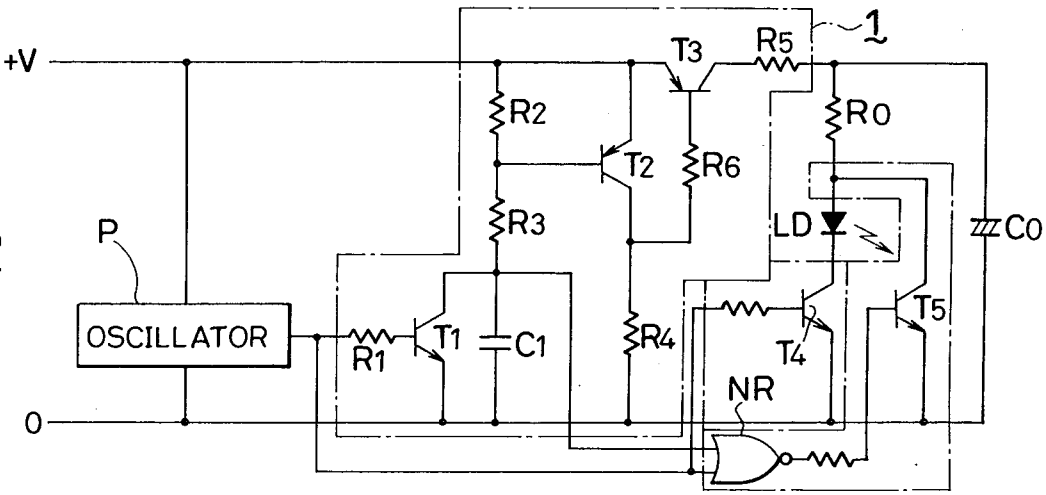
FIGS. 2 and 3. is a detailed circuit diagrams of one embodiment of a light emitting section and a light receiving section, respectively, of the smoke detector of the present invention.
Figure 3:
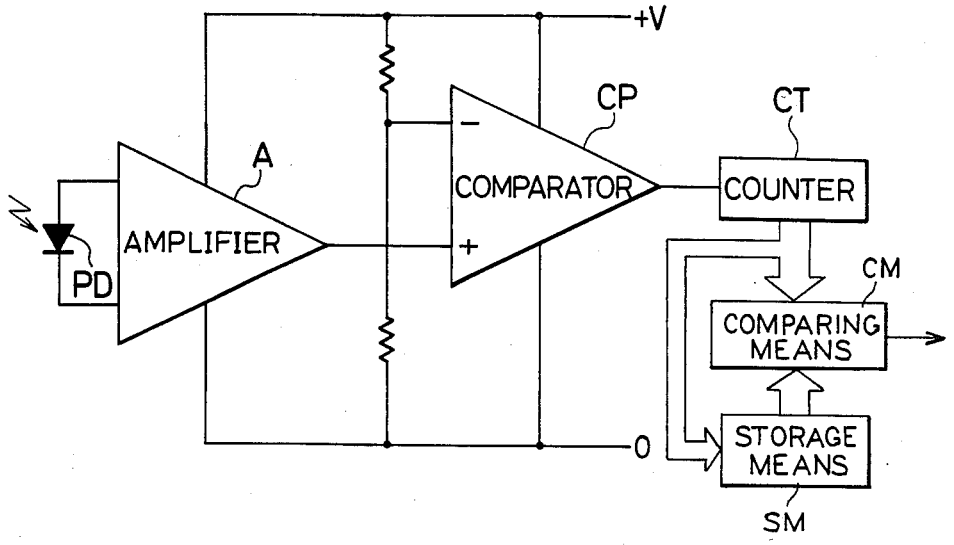

FIGS. 2 and 3 are respective detailed circuit diagrams of one embodiment of a light emitting section and a light receiving section in a separation type light extinction smoke detector of the present invention. In this embodiment, in order to allow simple signal processing, digital signal processing is adopted. More specifically, an oscillator P if provided in the light emitting section, which can have an arbitrary oscillation cycle. In this embodiment, the oscillator P continually emits 100 pulses of a 10-μsec cycle (100 kHz) every 5 seconds. Therefore, the oscillator P generates a 1-msec pulse and is turned off for 5 seconds. Power for a light emitting diode LD as a light emitting element is supplied from a capacitor $C_0$. A charge control circuit 1 for controlling charging of the capacitor $C_0$ has three transistors $T_1$ to $T_3$, six resistors $R_1$ to $R_6$, and a single capacitor $C_1$. The time constant of a series circuit consisting of the two resistors $R_2$ and $R_3$ and the capacitor $C_1$ is selected such that the capacitor $C_1$ is not charged by the ON/OFF operation of the transistor $T_1$ at about 100 kHz. Therefore, while the transistor $T_1$ repetitively performs the ON/OFF operations at least at 100 kHz, the transistor $T_2$ is kept ON and the transistor $T_3$is kept OFF, thus interrupting charging of the capacitor $C_1$. During a 5-sec OFF interval of the transistor $T_1$, the capacitor $C_1$ is immediately charged, so that the transistor $T_2$ is kept OFF and the transistor $T_3$ is kept ON, thus charging the capacit $C_0$. More specifically, the charge control circuit 1 operates such that the capacitor $C_0$ is charged during the 5-sec OFF interval of the oscillator P, and power to the light emitting diode LD is limited to the charges discharged from the capacitor $C_0$ during an interval in which the pulses are generated from the oscillator P, thus the light emitting diode LD is flickered.

A transistor $T_4$ supplies the charges discharged from the capacitor $C_0$ to the light emitting diode LD in response to the pulse output from the oscillator P to flicker the light emitting diode LD. In this case, if the duty ration of the pulse output is $\beta$, the discharge time constant of the capacitor $C_0$ is given by $R_0 \cdot C_0/\beta$, where the capacitance of the capacitor $C_0$ is $C_0$, the resistance of the resistor $R_0$ is $R_0$. Thus, the discharging operation can be performed along a relatively moderate characteristic curve, and light-emitting current consumption can be conserved. However, in order to simplify the description, a discharge path consisting of a NOR gate NR and a transistor $T_5$ is arranged in parallel with the series circuit consisting of the light emitting diode LD and the transistor $T_4$, so that the transistor $T_5$ is controlled by a NOR output of the pulse output and a charge potential signal of the capacitor $C_1$ in the charge control circuit 1. Thus, the transistor $T_5$ is turned on during an OFF period of the light emitting diode LD corresponding to the pulse output period to form the discharge path of the capacitor $C_0$. In this manner, during the pulse output period, the capacitor $C_0$ is continuously discharged.

Since the light emitting section is constituted as described above, the output I of light emitted from the light emitting diode LD as the light emitting element can be obtained by the following relation:

$$I = I_0 c^{-(t/C_0 R_0)}$$

A light receiving section for receiving this incident light includes at least an amplifier A for amplifying an output from a photodetector PD, a comparator CP for comparing the output from the amplifier A with an arbitrary set value and generating an output only when the output from the amplifer A exceeds the set value, and a counter CT for counting the output from the comparator CP. The counting operation of the counter CT is performed such that its count is updated for every pulse output period. A storage means SM and comparing means CM, described in detail below, are also schematically shown as connected to the output of the counter CT.

Therefore, a difference N of outputs of the counter CT according to the presence/absence of smoke can be obtained as the product of the difference $T_s$ of the periods corresponding thereto and a frequency f of the pulse output (in this embodiment, 100 kHz), as follows:

$$N = -f \cdot C_0 R_0 \ln(1-K)$$

When the difference N of the outputs of the counter CT is monitored, a change in attenuation rate can be detected. In other words, the density of smoke can be detected.

Figure 4:
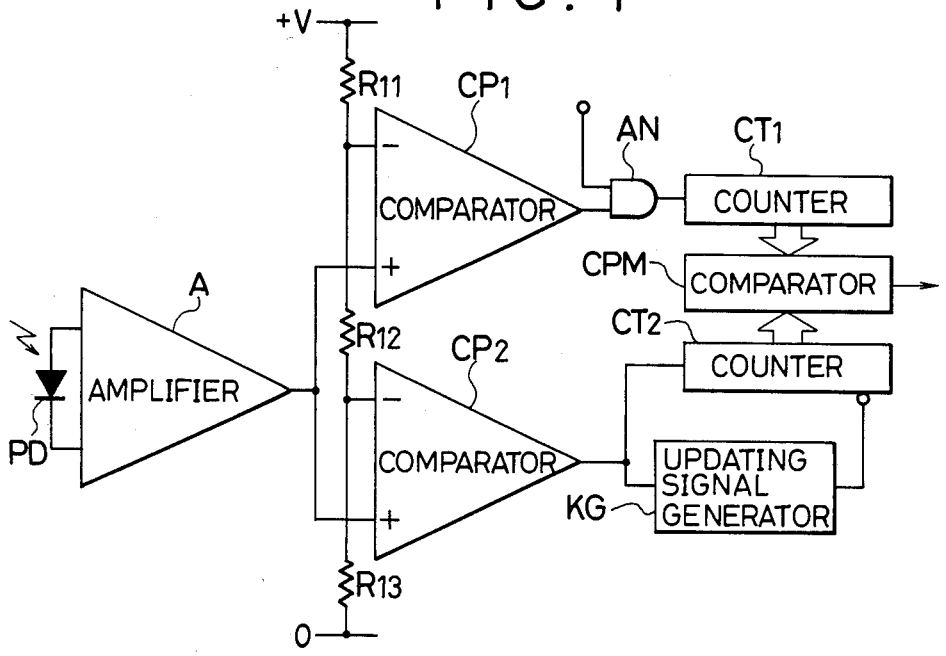
FIG. 4 is a detailed circuit diagram of another embodiment of a light receiving section of the smoke detector of the present invention.

In practice, a circuit arrangement for obtaining the difference N of the outputs of the counter CT if required. FIG. 4 is a detailed circuit diagram of another embodiment of a light receiving section having a circuit for obtaining the difference N of the counter counts. The same reference numerals in FIG. 4 denote the same parts as in FIGS. 2 and 3, and a detailed description thereof will be omitted. The light receiving section of this embodiment includes an amplifier A for amplifying an output from a photodetector PD; two comparators $CP_1$ and $CP_2$ for comparing the output from the amplifier A with set values which are set to allow generation of an alarm at an attenuation rate k and for generating an output only when the output exceeds the set value; two counters $CT_1$ and $CT_2$ for respectively counting the outputs from the comparators $CP_1$ and $CP_2$; and a comparator CPM (e.g., a magnitude comparator) for comparing the outputs from the counters $CT_1$ and $CT_2$ to generate an alarm signal. In order to determine the set values of the comparators $CP_1$ and $CP_2$ so as to generate an alarm at the atrenuation rate k, if the set values are given by $V_A$ and $V_B$, respectively, the resistances of voltage dividing resistors $R_{11}$, $R_{12}$, and $R_{13}$ are determined so as to yield $V_B=(1-k)V_A$. The output from the comparator $CP_1$ having the higher set value is supplied to the counter $CT_1$ AND gate AN only when a set instruction signal is supplied to the AND gate AN. The output from the comparator $CP_2$ having the lower set value is also supplied to an updating signal generator KG for generating an updating signal to the counter $CT_2$, so that the count of the counter $CT_2$ is updated for every pulse output period. The updating signal generator KG comprises, e.g., a monostable multivibrator, and generates pulses having a pulse width longer than the pulse output period of the oscillator P and shorter than its OFF period. The trailing edge of the pulse is used as the updating signal.

When the light receiving section is arranged as above, initial setting and changing of the set values can be easily performed. When the set instruction signal is supplied to the AND gate AN, the output from the comparator $CP_1$ having the high set value is then supplied to the counter $CT_1$ and is set as a reference value for comparison. Assuming that the attenuation rate at that time is $k_0$, the counts $N_A$ and $N_B$ of the counters $CT_1$ and $CT_2$ are represented by the following relations:

$$N_A = -f \cdot C_0 R_0 \ln\{V_A/(1-k_0)AI_0\}$$

$$N_B = -f \cdot C_0 R_0 \ln\{V_B/(1-k_0)AI_0\}$$

When smoke is generated and the attenuation rate k changes, the count $N_B'$ of the counter $CT_2$ which is continually updated is expressed by:

$$\begin{aligned} N_B' &= -f \cdot C_0R_0\ln\{V_B/(1-k)(1-k_0)AI_0\} \\ &= -f \cdot C_0R_0\ln\{(1-k)V_A/(1-k)(1-k_0)AI_0\} \\ &= -f \cdot C_0R_0\ln\{V_A/(1-k_0)AI_0\} \\ &= N_A \end{aligned}$$

Therefore, the comparator CPM is arranged to produce an output signal when the output $N_B'$ of the counter $CT_2$ which is continually updated is equal to the output $N_A$ of the counter $CT_1$ for setting the other reference value, or when the relation $N_B<N_A$ is established, thereby generating an alarm signal.

In this embodiment, the alarm signal is generated from the light receiving section. However, if the outputs from the counters are processed by a remote processing device, the complex arrangement shown in FIG. 4 need not be arranged in the light receiving section, and a count corresponding to a smoke density need only be supplied to the processing device side, as shown in FIG. 3.

Using the detector disclosed herein, initial setting or changing of a set value immediately after installation can be performed by simply storing the count value in the storage means, unlike a conventional device which requires the above setting operations to be performed by finely adjusting an amplifier connected to the output terminal of a light receiving element. In this manner, the setting operation requires no skill and can be completed smoothly.

Although modifications and changes may be suggested by those skilled in the art it is the intention of the inventor to embody within the patent warranted hereon all changes and modifications as reasonably and properly come within the scope of his contribution to the art.

I claim as my invention:

1. A smoke detector comprising:

means for emitting light, said light being attenuated by the presence of smoke;

means for detecting said light spaced from said means for emitting light;

drive means for said means for emitting light, said drive means changing the emission intensity of said light according to a predetermined cyclically repeated changing mode;

counting means connected to said means for detecting light for generating a count corresponding to a period during which the light from said means for emitting light is within a predetermined intensity range for each cycle;

storage means connected to said counting means for storing a count of said counting means corresponding to said period in an arbitrary cycle; and comparing means for comparing the count stored in said storage means with a count from said counting means corresponding to said period for a current cycle, said comparing means initiating an alarm signal based on the comparison.

2. A smoke detector as claimed in claim 1, wherein said counting means comprises:

a first comparator having an input connected to said means for detecting light and a reference input, said first comparator comparing the output of said means for detecting light with a reference signal;

an updating signal generator having an input connected to the output of said first comparator, said updating signal generator generating an updated signal for each cycle; and a first counter connected to the output of said first comparator and to the output of said updating signal generator, said first counter generating said count corresponding to said period in response to said updating signal.

3. A smoke detector as claimed in claim 2, wherein said storage means comprises:

a second comparator having an input connected to an output of said means for detecting light and a reference input, said second comparator comparing the output of said means for detecting light with a reference signal which is higher than the reference signal supplied to said first comparator;

an AND gate having an input connected to the output of said second comparator and a control input for through-connecting the output of said second comparator in said arbitrary cycle; and a second counter having input connected to the output of said AND gate for counting said period in said arbitrary cycle.

4. A smoke detector as claimed in claim 3, wherein said reference signal supplied to said first comparator is $V_A$, said reference signal supplied to said second comparator is $V_B$, a reference attenuation rate of the emission intensity of said light from said means for emitting light is defined by $k_0$, and wherein the reference signals $V_A$ and $V_B$ have the following relation: $V_B=(1-k_0)\ V_A$.

5. A smoke detector as claimed in claim 4, further comprising an amplifier having an output A connected between said means for detecting light and each of said first and second comparators, a capacitor $C_0$ and a resistance $R_0$ in said means for emitting light, and wherein said first and second counters have respective outputs $N_A$ and $N_B$ defined by the following relations:

$$N_A=-f\cdot C_0R_0\ln\{V_A/(1-K_0)AI_0\}$$

$$N_B=-f\cdot C_0R_0\ln\{V_B/(1-K_0)AI_0\}$$

wherein f is the frequency of said repeated cycle, and wherein said second counter has a count $N_B'$ when said reference attenuation rate $K_0$ changes to k in the presence of smoke which is updated to generate an alarm signal according to the following relation:

$$N_B'=-f\cdot C_0R_0\ln\{V_B/(1-k_0)AI_0\}.$$

6. A smoke detector as claimed in claim 5, wherein said updating signal generator is a monostable multivibrator.

7. A detector as claimed in claim 6, wherein said comparing means includes a magnitude comparator.

* * * * *